US007140704B2

(12) United States Patent
Chen et al.

(10) Patent No.: US 7,140,704 B2
(45) Date of Patent: Nov. 28, 2006

(54) LOCATING DEVICE FOR A SLIDE

(75) Inventors: Ken-Ching Chen, Kaohsiung Hsien (TW); Shih-Long Hwang, Kaohsiung Hsien (TW); Shun-Ho Yang, Kaohsiung Hsien (TW); Chun-Chiang Wang, Kaohsiung Hsien (TW)

(73) Assignee: King Slide Works Co., Ltd., Kaohsiung Hsieh (TW)

( * ) Notice: Subject to any disclaimer, the term of this patent is extended or adjusted under 35 U.S.C. 154(b) by 215 days.

(21) Appl. No.: 10/917,432

(22) Filed: Aug. 13, 2004

(65) Prior Publication Data

US 2006/0033409 A1 Feb. 16, 2006

(51) Int. Cl.
*A47B 88/00* (2006.01)

(52) U.S. Cl. ..... 312/334.44; 312/333

(58) Field of Classification Search ..... 312/333, 312/334.44, 334.46, 334.47, 334.1, 334.7, 312/334.8; 384/21, 22
See application file for complete search history.

(56) References Cited

U.S. PATENT DOCUMENTS

| | | | | |
|---|---|---|---|---|
| 461,375 | A * | 10/1891 | Spaunhorst | 312/330.1 |
| 2,277,703 | A * | 3/1942 | Kennedy et al. | 384/21 |
| RE28,344 | E * | 2/1975 | Monaco | 384/21 |
| 6,464,311 | B1 * | 10/2002 | Liang et al. | 312/334.46 |
| 6,585,335 | B1 * | 7/2003 | Hwang et al. | 312/333 |

* cited by examiner

*Primary Examiner*—Janet M. Wilkens
(74) *Attorney, Agent, or Firm*—Rosenberg, Klein & Lee

(57) ABSTRACT

A locating device for a slide is to install a locator at the rear end of an outer track. The locator is formed by blanking and bending a flexible metal piece, and its main body is to form a U-shaped base in cross-section with two vertical edges extending upwardly from respective sides. The base of the locator is formed with holes and riveted to the outer track. The base further extends a portion upwardly from the rear end to form a vertical plate comprising a pair of hooks extending from the top end of the vertical plate towards the front end. The hooks engaging with a buckle device of an inner track or of a middle track secures the inner track and the outer track together.

7 Claims, 5 Drawing Sheets

LOCATING DEVICE FOR A SLIDE

BACKGROUND OF THE INVENTION

1. Field of the Invention

This invention relates to locating device for a slide, and more particularly to a locator deposed at a rear end of an outer track to be engaged with an inner track for securing purpose.

2. Description of the Prior Art

A conventional three-stage slide generally comprises an outer track (fixed track), a middle track (loading track) and an inner track (mobile track). Taking a closet with its drawer as an example, the outer track is secured to the inner side of the closet, while the inner track is each secured to respective sides of the drawer. The middle track is inserted to the fixed track with auxiliary parts, such as ball bearings to slide along the inner track in a reciprocal movement along the same axial direction in relation to the outer track. Another slide uses a latch design to secure the tracks at place at the extension position, such as U.S. Pat. No. 6,464,311.

Further, when the slide is pulled to its extended position, or when it is pushed to a collapsed position, a securing device shall make the product safer.

SUMMARY OF THE INVENTION

It is the primary advantage of the present invention to provide a locating device for a slide, which is safer in use.

It is another advantage of the present invention to provide a locating device for a slide, which is easy to operate.

It is a further advantage of the present invention to provide a locating device for a slide, which has a longer life span.

DETAILED DESCRIPTION OF THE PREFERRED EMBODIMENT

Figure 1:
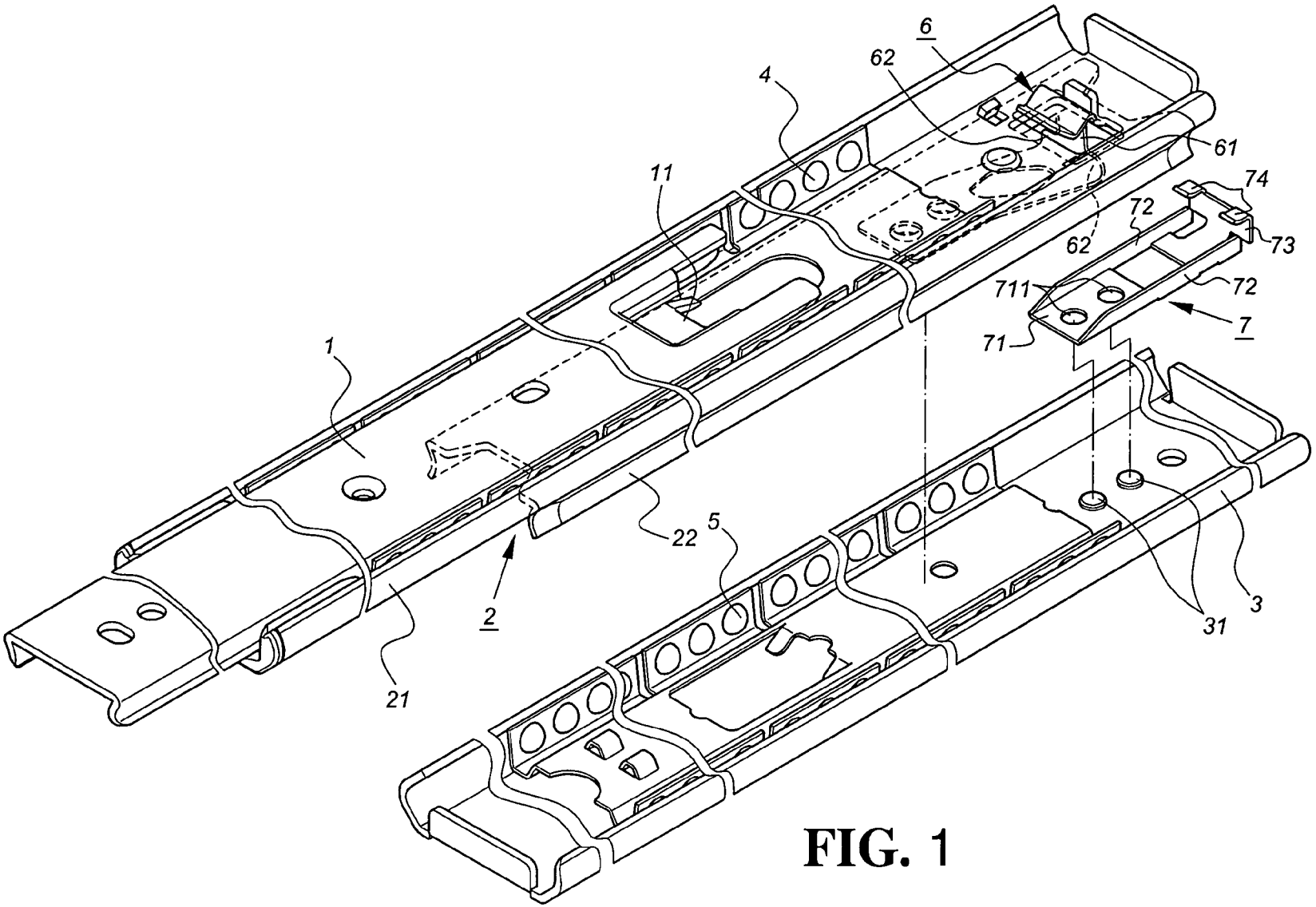
FIG. 1 is an exploded view of a first embodiment of the present invention.
Figure 2:
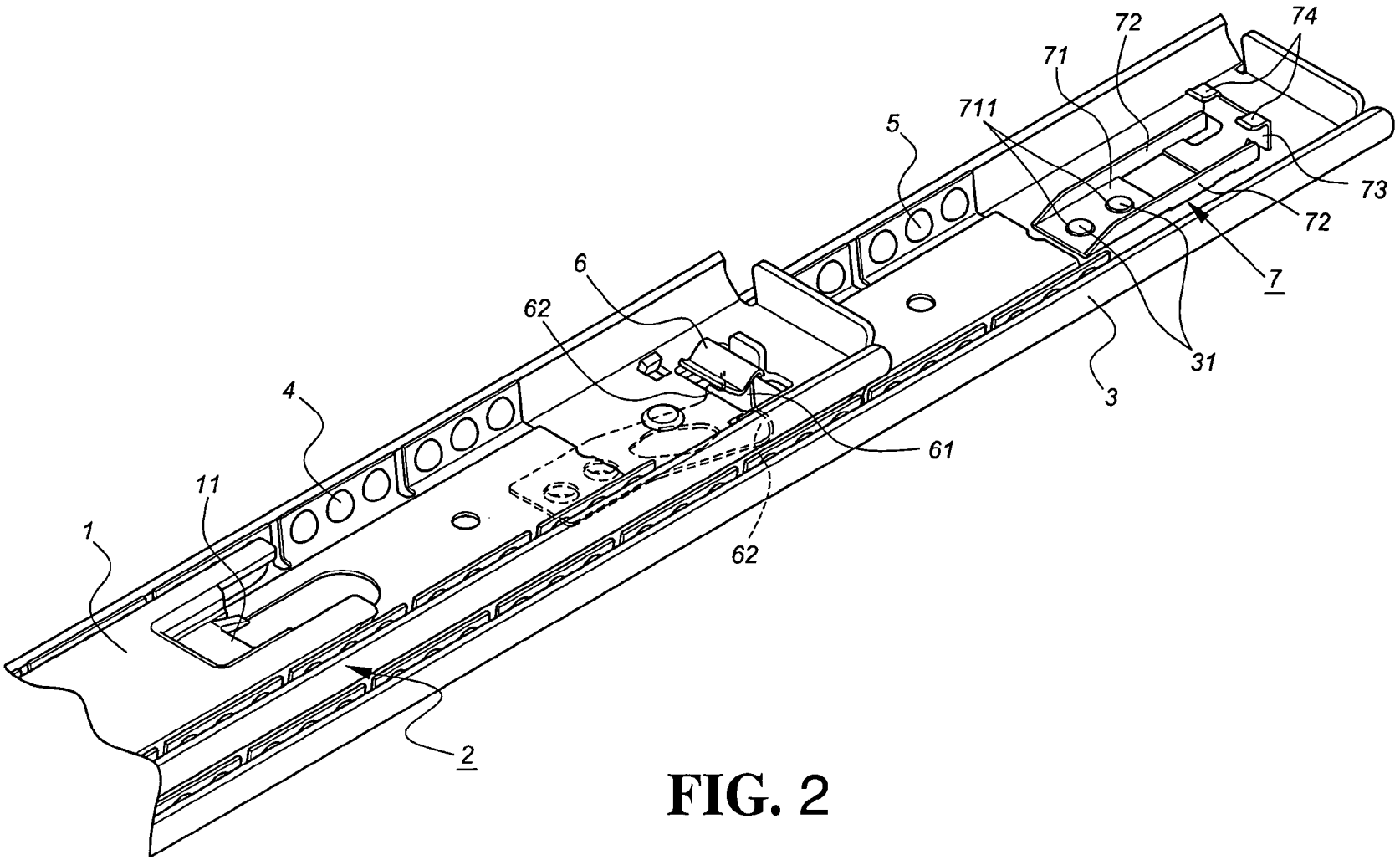
FIG. 2 is a perspective view of the first embodiment of the present invention.

A preferred embodiment of a locating device for a three-stage slide, as shown in FIGS. 1 and 2, comprises an inner track 1 inserted and connected to a main track 21 of a middle track set 2. The main track set 2 uses an auxiliary track 22 secured with the main track 21 to connect to an outer track 3. Two auxiliary sliding parts 4 and 5 are respectively located between the inner track 1 and the main track 21 as well as between the auxiliary track 22 and the outer track 3 to facilitate sliding movement. The middle track set 2 comprises a locking strip 6 at the rear end. The locking strip 6 extends upwardly a vertical section having a reduced portion 61 thereof with a pair of shoulders 62 under the reduced portion 61 as a buckle device. Corresponding to the locking strip 6, a release device 11 is formed at rear end of the inner track 1. The aforesaid describes a three-stage slide design, which is not the claimed item, and therefore will not be described any further.

A locator 7 is deposed at the rear end of the outer track 3. The locator 7 is formed by blanking and bending a flexible metal piece to form a U-shaped base 71 in cross-section. The base 71 has a pair of vertical edges 72 extending upwardly from respective sides. The vertical edges 72 are adapted to maintain a height level of the locking strip 6. The bottom of the base 71 is formed with holes 711 for securing the base 71 with rivets 31 protruding from the outer track 3. The base 71 further extends a portion upwardly from the rear end to form a vertical plate 73. The vertical plate 73 comprises a pair of hooks 74 extending from the top end of the vertical plate 73 towards the front end.

Figure 3:
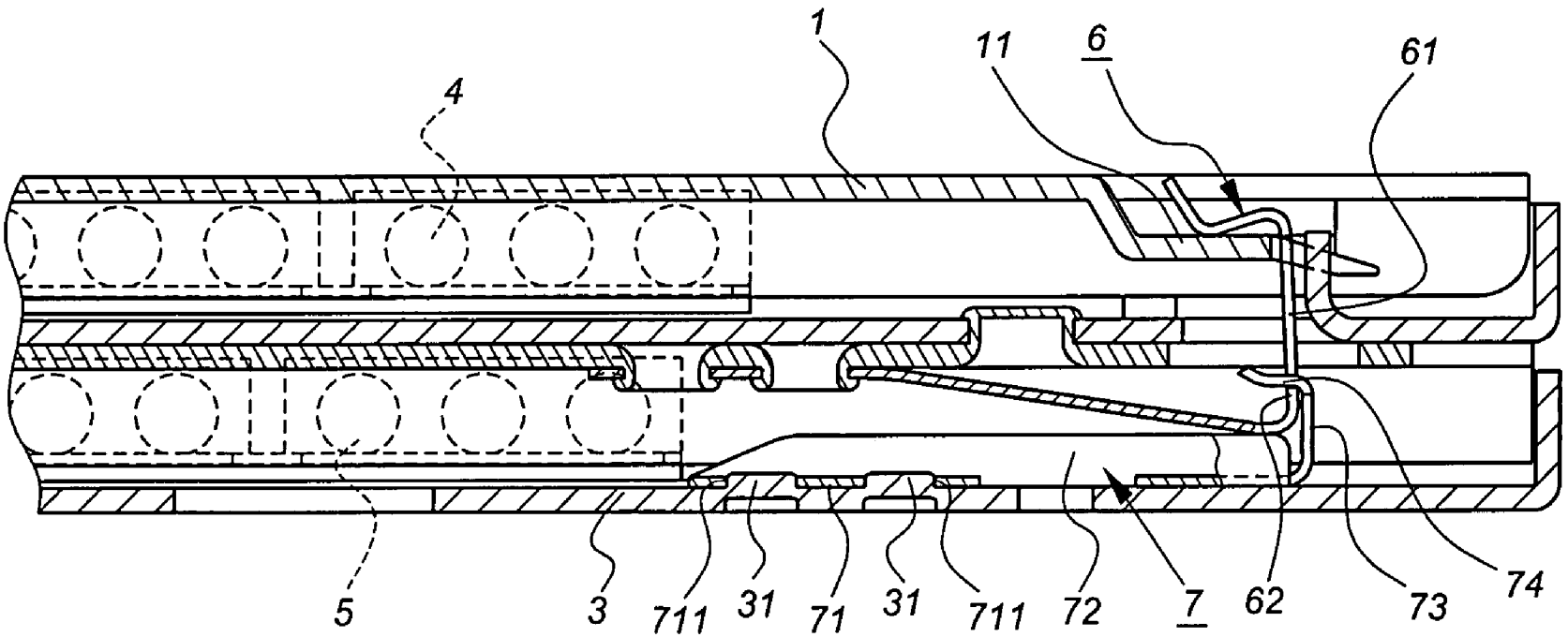
FIG. 3 is a cross-sectional view showing a collapsed status of the present invention.

To collapse the slide, as shown in FIG. 3, a user pushes a drawer inwardly, which brings the inner track 1 to move inward until the release unit 11 is clamped with the locking strip 6 of the middle track set 2 and is brought to the rear end of the outer track 3. Upon reaching to the end, the hooks 74 of the vertical plate 73 of the locator 7 will engage with the shoulders 62 of the locking strip 6 that secures the inner track 1 to the middle track set 2. The hooks 74 of the locator 7 engage with the locking strip 6 so as to secure the middle track set 2 with the outer track 3.

Figure 4:
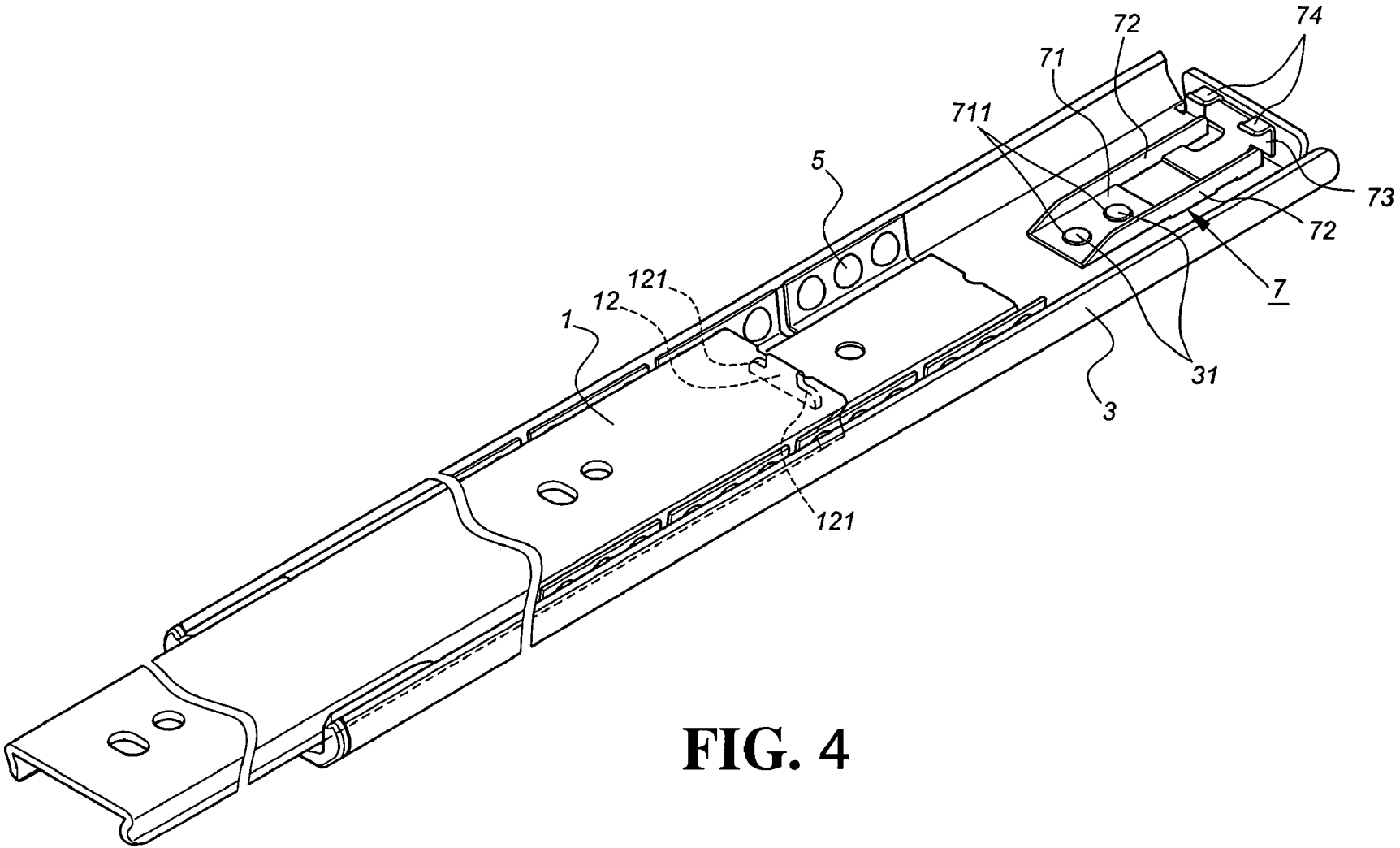
FIG. 4 is a perspective view of a second embodiment of the present invention.

The inner track 1 uses the locking strip 6 deposed on the middle track set 2 as a buckle device to secure with the locator 7. However, this is not the only method of locking the track. Further, the main track 21 connected with the auxiliary track 22 to form the middle track set 2 is neither a sole design of the loading track. The prior art also includes a three-stage slide with a single track as the middle track. Taking a two-stage slide as an example, the inner track 1 slides on the auxiliary sliding part 5 to connect with the outer track 3, as shown in FIG. 4. This is also part of the scope of locator 7.

Figure 5:
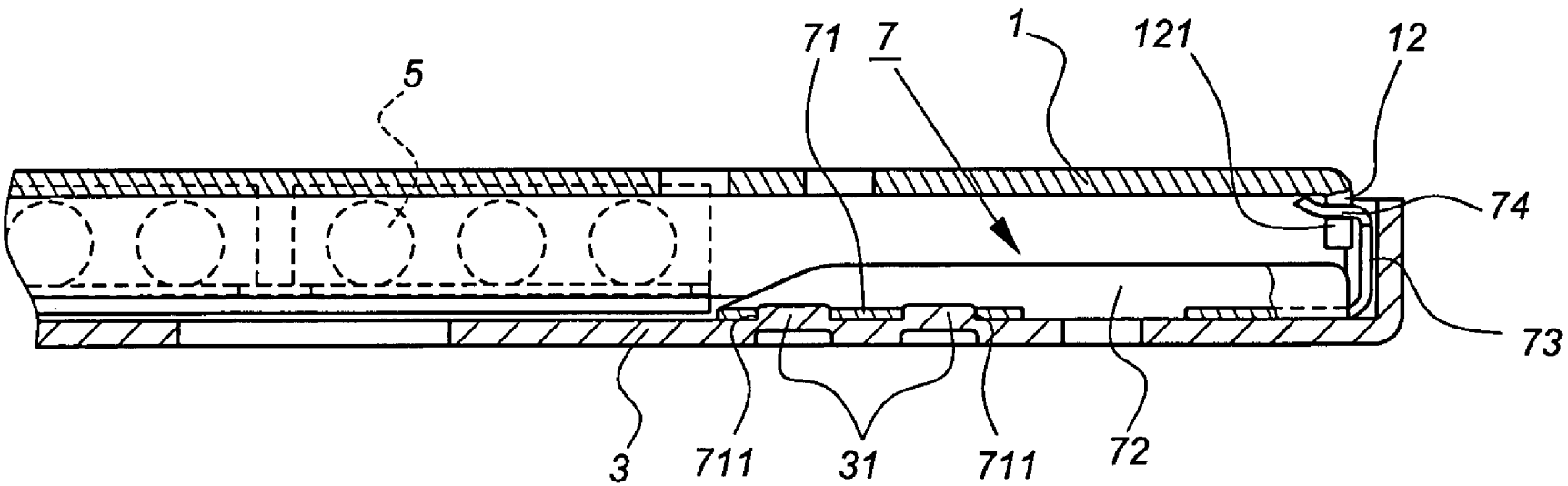
FIG. 5 is a cross-sectional view showing a collapsed status of the second embodiment of the present invention.

Accordingly, the two-stage slide, as shown in FIG. 4, also has the locator 7 at the rear end of the outer track 3, while the rear end of the inner track 1 is bent towards the outer track 3 to form a buckle device 12. The buckle device 12 has a pair of shoulders 121 extending from respective sides of the buckle device 12 downwardly. When the inner track 1 is collapsed and reaches to the end of the outer track 3, as shown in FIG. 5, the hooks 74 of the locator 7 engage with the shoulders 121 of the buckle device 12, thus the track is locked securely.

The inner track 1 comprises the buckle device 12 at the rear end for engagement with the hooks 74 of the locator 7, as the foresaid. When the inner track 1 and the outer track 3 are added with a middle track to form a three-stage slide, this design may also work perfectly. All it has to do is to leave a space between the rear end of the middle track corresponding to the hooks 74 of the locator 7, or to cut off a portion of the middle track in order to operate the locator 7 to collapse the inner track 1.

Therefore, no matter it is a two-stage slide or a three-stage slide, the hooks 74 of the locator 7 of this invention can secure the inner track 1 and the outer track 3 together.

What is claimed is:

1. A slide assembly having a locating device wherein said slide assembly comprises an inner track inserted through and connected with a main track of a middle track set, said middle track set connected with an outer track, through an auxiliary track, an auxiliary sliding part being each disposed between said inner track and said main track as well as between said auxiliary track and said outer track to facilitate extending among the tracks, said middle track set comprising a locking strip at a rear end thereof, and characterized in that:

said locating device comprising a locator having a base riveted on a rear end of said outer track, said base having a vertical plate extending from a rear end upwardly and a pair of hooks extending forward from a top end of said vertical plate;

said locking strip deposed at the rear end of said middle track set corresponding to said locator as a buckle device, said locking strip extending upwardly in a vertical direction having a reduced portion thereof, and a pair of shoulders underneath said reduced portion; and said inner track sliding into said middle track set, both said inner track and said middle track sliding together into said outer track, and said hooks of said locator engaging with said shoulders of said locking strip.

2. The slide assembly, as recited in claim 1, wherein said locator is formed by blanking and bending a flexible metal piece.

3. The slide assembly, as recited in claim 1, wherein said base of said locator is formed with holes for securing said base with rivets protruding from said outer track.

4. The slide assembly, as recited in claim 1, wherein said base comprises a pair of vertical edges extending upwardly from both sides to maintain a height level of said locking strip.

5. A slide assembly having a locating device wherein said slide assembly comprises an inner track, an outer track, and an auxiliary sliding part, characterized in that:

said locating device comprising a locator at a rear end of said outer track, said locator comprising a base to be secured to said outer track, said base comprising a vertical plate extending upwardly from a rear end thereof, said vertical plate comprising a pair of hooks extending forward from a top end of said vertical plate;

said inner track comprising a buckle device at a rear end corresponding to said locator, said buckle device comprising a buckle at the rear end of said inner track and a pair of shoulders extending from lower respective ends of said buckle; and said inner track being collapsed to said outer track, and said hooks of said locator engaging with said shoulders of said buckle.

6. The slide assembly, as recited in claim 5, wherein said locator is formed by blanking and bending a flexible metal piece.

7. The slide assembly, as recited in claim 5, wherein said base of said locator is formed with holes for securing said base with rivets protruding from said outer track.

* * * * *